US012286734B2

(12) United States Patent
Nikinmaa et al.

(10) Patent No.: US 12,286,734 B2
(45) Date of Patent: Apr. 29, 2025

(54) METHOD FOR PRODUCING NONWOVEN FABRIC AND NONWOVEN FABRIC

(71) Applicant: Suominen Oyj, Helsinki (FI)

(72) Inventors: Miika Nikinmaa, Espoo (FI); Avinav G. Nandgaonkar, Northborough, MA (US)

(73) Assignee: SUOMINEN OYJ, Helsinki (FI)

( * ) Notice: Subject to any disclaimer, the term of this patent is extended or adjusted under 35 U.S.C. 154(b) by 45 days.

(21) Appl. No.: 17/967,916

(22) Filed: Oct. 18, 2022

(65) Prior Publication Data

US 2023/0122829 A1 Apr. 20, 2023

Related U.S. Application Data

(60) Provisional application No. 63/256,674, filed on Oct. 18, 2021.

(51) Int. Cl.
*D04H 1/492* (2012.01)
*D04H 1/425* (2012.01)
(Continued)

(52) U.S. Cl.
CPC ..... *D04H 1/492* (2013.01); *D04H 1/425* (2013.01); *D04H 1/4266* (2013.01); *D10B 2201/06* (2013.01); *D10B 2201/08* (2013.01)

(58) Field of Classification Search
CPC ..... D04H 1/492; D04H 1/465; D04H 1/425; D04H 1/4266; D04H 1/4258; D04H 1/46;
(Continued)

(56) References Cited

U.S. PATENT DOCUMENTS 3,485,706 A * 12/1969 Evans ..... D04H 1/495 162/204
3,494,821 A * 2/1970 Evans ..... D04H 18/04 442/352
(Continued)

FOREIGN PATENT DOCUMENTS

CN 107119389 A 9/2017
CN 107201601 A 9/2017
(Continued)

OTHER PUBLICATIONS

English translation of CN 107201601 (Yang); Doc Pub Sep. 26, 2017 (Year: 2017).*
(Continued)

*Primary Examiner* — Amy Vanatta
(74) *Attorney, Agent, or Firm* — Timothy H. Van Dyke; Wolter Van Dyke Davis, PLLC

(57) ABSTRACT

According to an aspect of the present invention, there is provided a method for producing a nonwoven fabric, the method comprising the steps of providing fibres comprising 10-100 wt-% of bast fibres, the bast fibres having at least one angle of at least 20°, and the bast fibres having an average fibre length of 10-60 mm; carding the fibres and forming a web of fibres on a wire support; hydroentangling the formed web by using at least a first and a second hydroentangling unit, wherein a hydroentanglement energy in the first hydroentangling unit is lower than the hydroentanglement energy in the second hydroentangling unit; dewatering the hydroentangled web; and drying the dewatered web at a temperature of 105-125° C.

17 Claims, 2 Drawing Sheets

(51) Int. Cl.
*D04H 1/4258* (2012.01)
*D04H 1/4266* (2012.01)

(58) Field of Classification Search
CPC . D04H 1/49; D04H 5/03; D04H 18/04; D10B 2201/06; D10B 2201/08
USPC ..... 28/104, 105
See application file for complete search history.

(56) References Cited

U.S. PATENT DOCUMENTS

| | | | | |
|---|---|---|---|---|
| 5,292,581 | A * | 3/1994 | Viazmensky | D21H 21/20 428/326 |
| 5,958,186 | A * | 9/1999 | Holm | D21F 11/00 162/99 |
| 9,949,609 | B2 | 4/2018 | Baer et al. | |
| 2010/0075120 | A1* | 3/2010 | Gustafsson | D04H 5/08 156/73.2 |
| 2010/0227138 | A1* | 9/2010 | Ouellette | B32B 5/08 28/104 |
| 2014/0066872 | A1* | 3/2014 | Baer | D04H 1/492 28/169 |
| 2016/0201239 | A1* | 7/2016 | Baer | D04H 1/425 156/60 |
| 2020/0224344 | A1 | 7/2020 | Redmann et al. | |
| 2021/0114341 | A1* | 4/2021 | Bogren | D04H 1/43835 |
| 2022/0341063 | A1* | 10/2022 | Finnis | D04H 1/425 |
| 2024/0183089 | A1* | 6/2024 | Goenka | D03D 15/283 |

FOREIGN PATENT DOCUMENTS

| | | | | |
|---|---|---|---|---|
| CN | 110685019 | A | 1/2020 | |
| CN | 112154231 | A * | 12/2020 | D04H 1/425 |
| EP | 4077786 | B1 * | 10/2024 | D04H 1/492 |
| WO | WO2010012737 | A2 | 2/2010 | |
| WO | WO2021059208 | A1 | 4/2021 | |

OTHER PUBLICATIONS

English translation of CN 107119389; Doc Pub Sep. 1, 2017 (Year: 2017).*

Guidelines for Assesing the Flushability of Disposable Nonwoven Products—A Process for Assessing the Compatibility of Disposable Nonwoven Products with Plumbing and Wastewater Infrastructure. Inda and Edana, May 2018, vol. 4, pp. 1-39.

Soukupova et al: Studies on the Properties of Biodegradable Wipes made by the Hydroentanglement Bonding Technique. Textile Research Journal, May 1, 2007, vol. 77, No. 5, pp. 301-311.

* cited by examiner

METHOD FOR PRODUCING NONWOVEN FABRIC AND NONWOVEN FABRIC

FIELD

The present invention relates to a method for producing nonwoven fabric comprising bast fibres. The invention also relates to a nonwoven fabric comprising bast fibres.

BACKGROUND AND OBJECTS

Bast fibres are natural fibres obtained from the phloem or bast of the stem of certain plants, including but not limited to jute, kenaf, flax and hemp. The bast fibres are initially recovered as bundles of individual fibres, which adhere to each other via pectin. Preferably, at least some of the pectin is removed to allow the bast fibres to be processed and used further. The bast fibres may also be mechanically or chemically cleaned to a trash content of for example 0.1 to 10 wt-%

Nonwovens are widely used for various products, such as wipes, both as dry wipes and wet wipes. Disposable wipes may be needed in many applications, for example for hygienic reasons. In view of the environmental aspect, it may also be preferable if the material is biodegradable, i.e. that it degrades into harmless components within a given time, in certain environmental conditions.

It is an aim of the present disclosure to provide a method for producing a nonwoven fabric, which comprises bast fibres. Preferably, the nonwoven fabric thus obtained only contains fibres that fulfil the requirements of biodegradability. A further aim is to provide a nonwoven fabric that comprises bast fibres and at the same time, has suitable properties to be used for the manufacturing of dry and wet wipes. A still further aim is to provide a nonwoven fabric which can be used for the manufacturing of dispersible flushable wipes.

SUMMARY OF THE INVENTION

The invention is defined by the features of the independent claims. Some specific embodiments are defined in the dependent claims.

According to a first aspect, there is provided a method for producing a nonwoven fabric, the method comprising the steps of

- providing fibres comprising 10-100 wt-% of bast fibres, the bast fibres having at least one angle of at least 20°, and the bast fibres having an average fibre length of 10-60 mm,
- carding the fibres and forming a web of fibres on a wire support,
- hydroentangling the formed web by using at least a first and a second hydroentangling unit, wherein a hydroentanglement energy in the first hydroentangling unit is lower than the hydroentanglement energy in the second hydroentangling unit,
- dewatering the hydroentangled web, and
- drying the dewatered web at a temperature of 105-125° C.

According to a second aspect, there is provided a nonwoven fabric comprising bast fibres having at least one angle of at least 20°, the bast fibres having an average fibre length of 10-60 mm, wherein, when compared to a nonwoven fabric manufactured in an identical manner and consisting of only viscose fibres of 1.7 dtex with an average length of 40 mm, the nonwoven fabric comprising bast fibres has a dry softness value in N/10 cm that is at least 70% higher than for the viscose nonwoven fabric and a wet softness value in N/10 cm that is less than 60% higher than for the viscose nonwoven fabric, the softness values being measured using a sample of 160×180 mm attached at its central point to a mounting clip, which mounting clip is attached to a machine used for measuring friction factors according to ISO 8295:1995, which samples are thereafter drawn using a speed of 1000 mm/minute and force as in ISO 8295:1995, through an opening in a test plate, which opening has a stadium shape with a size of 45×15 mm with ends having a radius of 7.5.

DETAILED DESCRIPTION

Figure 1:
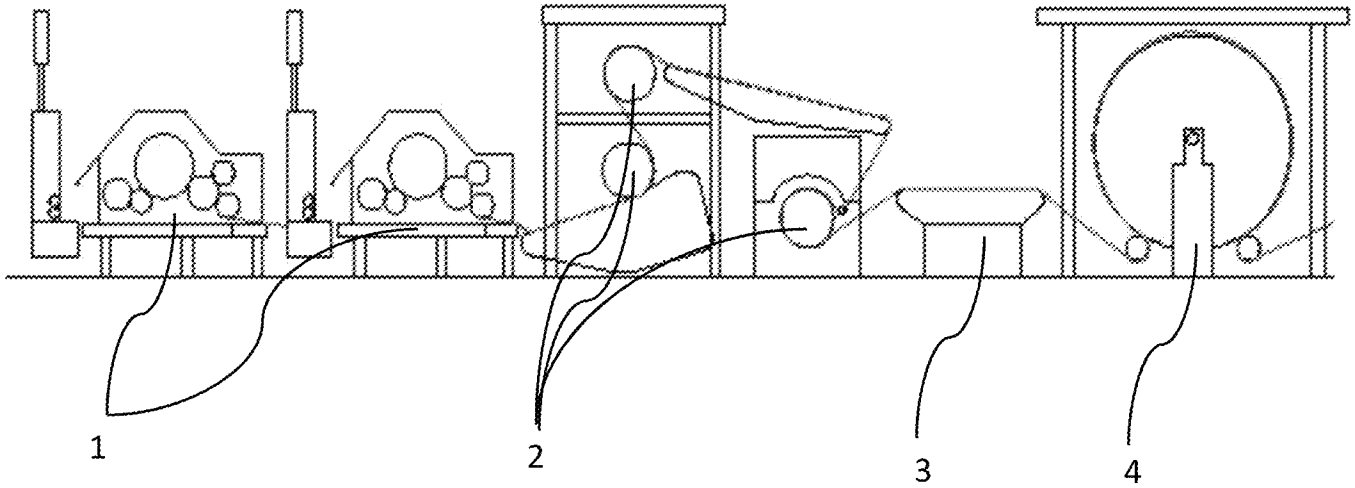
FIG. 1 illustrates a production line in accordance with an embodiment.

The present description relates to a method for producing a nonwoven fabric, the method comprising the steps of

- providing fibres comprising 10-100 wt-% of bast fibres, the bast fibres having at least one angle of at least 20°, and the bast fibres having an average fibre length of 10-60 mm,
- carding the fibres and forming a web of fibres on a wire support,
- hydroentangling the formed web by using at least a first and a second hydroentangling unit, wherein a hydroentanglement energy in the first hydroentangling unit is lower than the hydroentanglement energy in the second hydroentangling unit,
- dewatering the hydroentangled web, and
- drying the dewatered web at a temperature of 105-125° C.

The present method thus provides a process for manufacturing nonwoven fabric comprising bast fibres. Preferably, all the fibres used are biodegradable, so that the final nonwoven fabric is biodegradable, as hydroentangling does not add any component to the nonwoven fabric.

In the present description, biodegradable material is a material that can be broken down by bacteria so that it can be consumed by the environment. The degradation products are thus harmless. A typical degradation time is from a few months to a few years. The term dispersible flushable material refers to materials that can be flushed into sewage systems without risk of clogging the sewage pipes, and which then disperse and typically also biodegrade in the water purification system. Both biodegradation and dispersibility have been defined for nonwoven materials. Biodegradation can be tested for example using EN 14995:2006. The dispersibility can be tested for example according to INDA/EDANA GD4 (the Fourth Edition Guidelines for Assessing the Flushability of Disposable Nonwoven Products (2018)). The term man-made fibre in this description is used in the sense that it comprises all chemically produced fibres to distinguish them from the truly natural fibres such as cotton, wool, silk, flax etc. Thus, it encompasses for example fibres made from polymers synthesised from chemical compounds, e.g. acrylic, nylon, polyester, polyethylene, polyurethane, and polyvinyl fibres, modified or transformed natural polymers, e.g. alginic, and cellulose based fibres such as acetates, viscose, lyocell and rayon.

In the present description, the terms nonwoven fabric and nonwoven can be used interchangeably.

In the present method, if a mixture of different fibres is used, the mixture is preferably prepared prior to the carding. The fibres comprise 10-100 wt-% of bast fibres. The amount of bast fibres may thus be for example from 10, 15, 20, 25, 30, 35, 40, 45, 50, 55, 60, 65, 70, 75, 80, 85 or 90 wt-% up to 15, 20, 25, 30, 35, 40, 45, 50, 55, 60, 65, 70, 75, 80, 85, 90, 95 or 100 wt-% of the total amount of fibres. The fibres may comprise more than one type of bast fibres, such as two, three or four different types of bast fibres. The bast fibres have an average fibre length of 10-60 mm, the average being here the weight average.

The bast fibres have at least one angle, but the length is the length of straight fibres. The average fibre length can be for example from 10, 15, 20, 25, 30, 35, 40, 45, 50 or 55 mm up to 15, 20, 25, 30, 35, 40, 45, 50, 55 or 60 mm. The mass per unit length of the bast fibres can be for example 1-3 dtex, more specifically for example 1.5-2.3 dtex.

The bast fibres having at least one angle of at least 20°. The bast fibres can also be crimped. The bast fibres have thus at least one angle, and can have more than one angles, such as one angle/10 mm of fibre length, or for example for a 50 mm long fibre, it may have three angles. Angles in the bast fibres increase their ability to hydroentangle.

The value of the at least one angle is at least 20°. The angle may be for example from 20, 25, 30, 35, 40, 45, 50, 55, 60, 65, 70, 75, 80, 85, 90, 95, 100, 105, 110, 115, 120, 125, 130, 135, 140, 145, 150, 155, 160, 165 or 170° up to 35, 40, 45, 50, 55, 60, 65, 70, 75, 80, 85, 90, 95, 100, 105, 110, 115, 120, 125, 130, 135, 140, 145, 150, 155, 160, 165, 170 or 175°. Preferably, the angle is 30-80°. Bast fibres are typically wavy. It is to be understood that not all the fibres have necessarily the same angle, but instead, the angle may vary from one fibre to another. Typically, the angle is not exactly the same for each fibre, as the product is a natural product. The variation in the angle can be for example within 10 or 20% for the fibre batch. When a single fibre has more than one angle, the angles do not need to be identical, and the angles are most typically directed such that the overall aspect of the fibre is wavy (and not that the fibre is entangled on itself). The angle is measured such that the fibre is in a single plane.

Crimp is the waviness of a fibre, either natural waviness or waviness that is induced by chemical or mechanical means, such as crimping of synthetic fibres. The imposition of crimp to a specific frequency, as defined by a number of crimps per unit of fibre length, generates an overall fibre having a defined crimp profile, such as having a defined number of crimps per cm. In nonwoven processing, fibre crimp has an impact on production efficiency, and resulting fabric properties such as fabric bulk, bulk stability, and abrasion resistance. Bast fibres are naturally straight and do not have any significant fibre-to-fibre cohesion due to a lack of natural crimp. Crimp can however be added to the bast fibres, for example as described in WO 2021/059208. For example, the process of crimping may comprise providing an input of bast fibres; adjusting the moisture content of the bast fibres to be in the range of about 10 wt-% to about 40 wt-% (of the total weight of the fibres) to form a fibre mat; and contacting the fibre mat with a pair of heated crimping rolls to provide crimped bast fibres having a crimp of about 1 to about 10 crimps per centimetre, the pair of heated crimping rolls comprising a first crimping roll being positioned proximate to the top side of the fibre mat and opposing a second crimping roll positioned proximate to the bottom side of the fibre mat.

Prior to crimping, the bast fibres may optionally have been pre-treated with a coating (for example with a salt or polymer) in order to improve crimp retention. Such coating would need to be compatible with the end use of the nonwoven, i.e. for example biodegradable.

The crimps of the crimped bast fibres may be substantially triangular in shape. The crimp angle may be for example from 30° to 150°, for example from 60° to 120°, as measured from the tip of the crimp.

The bast fibres used here have at least one crimp per centimetre of fibre length. The bast fibres may have more than one crimp per centimetre of fibre length, such as 1.5, 2, 2.5, 3, 3.5, 4, 4.5, 5, 5.5, 6, 6.5, 7, 7.5, 8, 8.5, 9, 9.5 or 10 crimps per centimetre of fibre length.

The man-made fibres may also be crimped, but it is not believed to be necessary for the process to function and the finished product to have the desired properties. The present method and nonwoven may also comprise further fibres, such as cotton fibres or nettle fibres.

The present method comprises the step of carding the fibres and forming a web of fibres on a wire support. Carding separates the fibres and removes any possible impurities, while at the same time aligns and delivers them to be laid down as a web. The fibres in the web are thus aligned with each other predominantly in the same direction, which is mainly the machine direction. Furthermore, it is possible to use a randomizer as part of the card, which turns the fibres more into a cross direction of the web, leading to a higher strength in the cross direction. The fibres may also be randomly oriented in several directions. Further, it is also possible to use a so-called TT card, for example an eXcelle™ TT card by Andritz.

Instead of carding, the web can be formed by a wetlaid process.

After carding, the formed web is hydroentangled. Hydroentanglement is a method of bonding a web of fibres by entangling them by using high-pressure, columnar water jets. As the jets penetrate the web, fibre segments are carried by the highly turbulent fluid and become entangled with each other on a semimicro scale. In the present method, hydroentangling is carried out in the absence of any other component, such as a binder.

The hydroentanglement uses at least a first and a second hydroentangling unit, wherein a cumulative hydroentanglement energy in the first hydroentangling unit is lower than the cumulative hydroentanglement energy in the second hydroentangling unit. The hydroentanglement may also use more than two units, such as three, four or five, the units forming a hydroentangling section. Moreover, the units may be located on either side of the web, or the web may be turned such that the water jets are directed to the web from both sides of the web. In one embodiment, a first unit is located above the web, a second below the web and a third unit again above the web. Directing the hydroentanglement water jets from two opposite directions leads to even further improved properties of the finished nonwoven fabric. In one embodiment, the web, at the hydroentangling units, are not in contact with the wire support but rather, in contact with a drum against which the hydroentangling is carried out.

According to one embodiment, the hydroentanglement energy per injector at the first unit is 40-50 kW·h/tonne of water and at the second unit 70-90 kW·h/ton. In case a third unit is used after the second unit, the hydroentanglement energy per injector at the third unit is typically lower than at the second unit. Furthermore, in case hydroentanglement in carried out on both sides of the web, typically 40-60% of the cumulative energy is used on both sides, i.e. the cumulative energy from one side is close to the cumulative energy from the other side. The quantity of energy used at different units can of course be different from the above. The cumulative energy used at the first unit is typically in the order of 20-30% of the total energy used and the cumulative energy used at the second unit is typically in the order of 40-50% of the total, while the cumulative energy used at a third unit is in the order of 30-40% of the total energy used. In case of two units, the cumulative energy at the first unit is about 30-40% of the total and the cumulative energy at the second unit is about 60-70% of the total energy used. By cumulative energy is here meant the combined energy of the injectors of the unit. Indeed, each unit comprises typically 1-5 injectors, which extend over the width of the web. Each injector has a strip having a large number of nozzles, typically in the hundreds.

The method may further comprise additional steps after dewatering and drying, such as calendaring the dried web, slitting it and/or winding it. The method may also comprise some additional steps in the beginning, such as pre-wetting the fibres after carding and before hydroentangling, to enhance the hydroentangling and compressing the web. In case pre-wetting is used, the cumulative energy is in the order of 1-2% of the total energy in the process. The purpose of pre-wetting is thus to compact the fluffy fibre web, remove the air in the web, and effectively absorb the energy of water jet, so as to enhance the fibre entanglement effect.

According to an embodiment, the fibres used in the present method is a mixture of fibres comprising 10-90 wt-% of bast fibres and 10-90 wt-% of man-made fibres. The mixture is preferably formed before carding, although it is also possible to feed the different types of fibres or different types of fibre mixtures onto the wire support separately. It is also possible to make layered structures, for example by feeding one layer from one carding device. Furthermore, it is also possible to add for example an airlaid or unwind layer between, on top or below one or more carded layers.

The amount of bast fibres in the fibre mixture can be for example from 10, 15, 20, 25, 30, 35, 40, 45, 50, 55, 60, 65, 70, 75, 80 or 85 wt-% up to 15, 20, 25, 30, 35, 40, 45, 50, 55, 60, 65, 70, 75, 80, 85 or 90 wt-% of the total weight of the fibre mixture. The amount of man-made fibres may be 10, 15, 20, 25, 30, 35, 40, 45, 50, 55, 60, 65, 70, 75, 80 or 85 wt-% up to 15, 20, 25, 30, 35, 40, 45, 50, 55, 60, 65, 70, 75, 80, 85 or 90 wt-% of the total weight of the fibre mixture.

According to an embodiment, the bast fibres are selected from a group consisting of hemp fibres, nettle fibres, flax fibres, jute fibres, ramie fibres, kenaf fibres, and mixtures thereof. Preferably, the bast fibres are hemp fibres.

According to an embodiment, the man-made fibres are fibres based on cellulose. The man-made fibres may also be synthetic fibres that are biodegradable according to the above definition, such as polylactic acid (PLA). When cellulose-based fibres are used, they can be for example lyocell fibres, paper yarn, Ioncell® fibres, viscose fibres, Modal® fibres, alkali cellulose fibres, Spinnova® fibres, cellulose carbamate fibres, cellulose acetate fibres, paper pulp, microfibrillar cellulose, nanofibrillar cellulose, microcrystalline cellulose, regenerated cellulose fibres, Tencel® fibres, rayon fibres, cuprammonium rayon fibres, or mixtures thereof. The average length of the man-made fibres can be any suitable length. For example, the average length of the man-made fibres can be 20-60 mm, such as 30-50 mm. The mass per unit length of the man-made fibres can be for example 1-3 dtex, more specifically for example 1.5-2.3 dtex.

According to one preferred embodiment, the mixture of fibres comprises 40-60 wt-% of bast fibres and 40-60 wt-% of man-made fibres. The mixture of fibres even more preferably comprises 40-60 wt-% of hemp fibres and 40-60 wt-% of lyocell fibres.

The present description also relates to a nonwoven fabric comprising bast fibres having at least one angle of at least 20°, the bast fibres having an average fibre length of 10-60 mm, wherein, when compared to a nonwoven fabric manufactured in an identical manner and consisting of only viscose fibres of 1.7 dtex with an average length of 40 mm, the nonwoven fabric comprising bast fibres has a dry softness value in N/10 cm that is at least 70% higher than for the viscose nonwoven fabric and a wet softness value in N/10 cm that is less than 60% higher than for the viscose nonwoven fabric.

According to yet another embodiment, the present description relates to a nonwoven fabric obtainable by the method described above. The various embodiments and variants disclosed above in connection with the method apply mutatis mutandis to the nonwoven fabric.

Thus, the nonwoven fabric comprising bast fibres has a dry softness value in N/10 cm that is at least 70% higher than for the viscose nonwoven fabric and a wet softness value in N/10 cm that is less than 60% higher than for the viscose nonwoven fabric, the softness values being measured using a sample of 160×180 mm attached at its central point to a mounting clip, which mounting clip is attached to a machine used for measuring a friction factor according to ISO 8295:1995, which samples are thereafter drawn using a speed of 1000 mm/minute and force as in ISO 8295:1995, through an opening in a test plate, which opening has a stadium shape with a size of 45×15 mm with ends having a radius of 7.5.

In the test for softness, the mounting clip is attached to a wire, and the wire is attached to the same attachment point of the load cell as the sledge in the friction factor test according to ISO 8295:1995. The wire is non-extensible, as in test according to ISO 8295:1995. When test results are given for a wet nonwoven fabric, the fabric was wetted using Tergitol™ in a concentration of 0.1% aqueous solution, used in an amount of 3 g/g of nonwoven fabric. The samples (size as indicated above) were cut, arranged on a pile and weighted. The wetting solution was evenly applied on the pile using a pipette. The wetted pile was arranged in a plastic bag, which was hermetically closed. Thereafter, the plastic bag was rolled over to ensure that all samples are evenly wetted. Thereafter, the samples were kept in the plastic bag and stored overnight.

The dry softness value may even be at least 80, 90 100 or 110% higher than for the viscose nonwoven fabric, while at the same time the wet softness value may be less than 55, 50, 45, 40, 35, 30, 25, 20, 15 or 10% higher than for the viscose nonwoven fabric. Indeed, the dry softness of the present nonwoven is significantly different from that of viscose nonwoven (a lower softness value meaning a softer product), while the wet softness of the present nonwoven is close to that of viscose nonwoven. The dry softness of the material is thus significantly higher than for a viscose nonwoven fabric made in identical conditions.

Additionally, at the same time, the nonwoven fabric comprising bast fibres has a wet dynamic friction factor as measured according to ISO 8295:1995, except that the sample size is 120 mm×70 mm (120 mm in MD, 70 mm in CD), that is at least 7% lower than for the viscose nonwoven fabric. The web dynamic friction factor can even be at least 10, 15 or 20% lower than for the viscose nonwoven fabric. For the test on wet friction, the wetting solution (Tergitol™, in a concentration of 0.1% aqueous solution, used in an amount of 3 g/g of nonwoven fabric) was evenly applied on the pile using a pipette. The wetted pile was arranged in a plastic bag, which was hermetically closed. Thereafter, the plastic bag was rolled over to ensure that all samples are evenly wetted. Thereafter, the samples were kept in the plastic bag and stored overnight, this replacing the conditioning in ISO 8295:1995 for the wet samples (dry samples being conditioned according to the standard).

The properties of the present nonwoven fabric are thus such that the material can be used for dispersible flushable wipes, i.e. the wet and dry strengths are sufficient for the use as wipes, but the material's other properties ensure they can be flushed without risking clogging of sewage pipes.

The present nonwoven fabrics may indeed be used for example in baby wipes, cosmetic wipes, perinea wipes, disposable washcloths, kitchen wipes, bath wipes, hard surface wipes, glass wipes, mirror wipes, leather wipes, electronics wipes, disinfecting wipes, surgical drapes, surgical gowns, wound care products, protective coveralls, sleeve protectors, diapers and incontinent care and feminine care articles, nursing pads, air filters, water filters, oil filters, furniture or upholstery backing.

In the following Experimental part, some examples are given to further illustrate the invention.

EXPERIMENTAL PART

Different fibre mixtures were tested and the manufactured nonwoven fabrics were tested and compared to nonwoven fabric consisting either only of viscose fibres or only of lyocell fibres, manufactured with essentially the same process conditions.

The average length of the bleached hemp fibres (from Bast Fibre Technology) used was 20 mm, the fibre had one angle and the mass per unit length was 3.52 dtex. For both lyocell and viscose (both from Lenzing), the average fibre length was 40 mm and the mass per unit length was 1.7 dtex. Tencel® fibres from Lenzing had an average length of 40 mm and their mass per unit length was 1.2 dtex.

The production line was as illustrated in FIG. 1 with winding at its end. Speed of the production line was 125 m/min. The hydroentanglement unit had three units, of which the middle one was such that hydroentangling was effected on the web from a different direction than the first and third units. The fibre web was pre-wetter from above, using a cumulative energy of 1.4% of the total energy used. The cumulative energy of the first hydroentanglement unit was 22.8%, that of the second unit 42.3% and that of the third unit 33.5%, of the total energy used in the process. The temperature of the drying oven was 110° C.

Tables 1 and 2 below illustrates the fibre compositions of the different nonwoven fabrics manufactured according to two sets of experiments. In the first set of experiments (Examples 1-3) the aim was to find an optimum composition of hemp and lyocell fibres. In the second set of experiments (Examples 4-6), different materials were compared with each other.

TABLE 1

| Example | Ex. 1 | Ex. 2 | Ex. 3 | Comp. ex. 1 |
|---|---|---|---|---|
| Hemp fibres | 50 | 75 | 25 | |
| Viscose fibres | | | | |
| Lyocell fibres | 50 | 25 | 75 | 100 |
| Tencel ® fibres | | | | |

TABLE 2

| Example | Ex. 4 | Ex. 5 | Ex. 6 | Comp. ex. 2 | Comp. ex. 3 |
|---|---|---|---|---|---|
| Hemp fibres | 50 | 50 | 50 | | |
| Viscose fibres | 50 | | | 100 | |
| Lyocell fibres | | 50 | | | 100 |
| Tencel ® fibres | | | 50 | | |

Comparative example (Comp. ex.) 2 was made with only viscose fibres as described above and Comparative examples 1 and 3 with only lyocell fibres as described above.

The obtained nonwoven fabrics were submitted to several tests. The following tests were carried out, although not all tests for all fabrics. For most of the tests, from six to twelve parallel samples were tested and the results given as a numerical average of the parallel results. Results of the tests are given in Tables 3-8 below. MD stands for machine direction, CD for cross direction.

When test results are given for a wet nonwoven fabric, the fabric was wetted using Tergitol™ 15-S-9 from Acros organics, in a concentration of 0.1% aqueous solution, used in an amount of 3 g/g of nonwoven fabric. The samples (size as indicated for each test) were cut, arranged on a pile and weighted.

Application of the Tergitol™-solution was carried out slightly differently depending on the test. For the tests were the samples were drawn (i.a. tensile strength, elongation), a pile of samples was arranged in a container, and Tergitol™-solution was poured over the pile, in an amount sufficient to wet the samples. After one hour, the pile of samples was removed from the container, extra solution is carefully removed by squeezing the samples and further by pressing between dry sheets of fabric.

For the test on wet friction and wet softness, the wetting solution was evenly applied on the pile using a pipette. The wetted pile was arranged in a plastic bag, which was hermetically closed. Thereafter, the plastic bag was rolled over to ensure that all samples are evenly wetted. Thereafter, the samples were kept in the plastic bag and stored overnight.

For the test on wet thickness, the samples (10×10 cm), with a total weight of at least 1 g, were immersed in distilled water for one minute, while being attached to a mesh, thereafter the samples were let drip dry during 2 minutes. Thus, in this test, no Tergitol™-solution was used, only distilled water.

The basis weight in g/m$^2$ of the nonwoven fabric was measured using the method NWSP 130.1.R0 (20).

The thickness in mm of the nonwoven fabric was measured using the method NWSP 120.6.R0 (15).

The dry bulk and the wet bulk in m$^3$/g of the nonwoven fabric was determined by calculating the dry thickness divided by basis weight multiplied by 1000 (dry thickness/basis weight*1000).

The tensile strength in both machine direction (MD) and cross direction (CD) for dry and wet nonwoven fabric, in N/5 cm was measured according to NWSP 110.4.R0 (20).

The maximum elongation in % in both machine direction (MD) and cross direction (CD) for dry and wet nonwoven fabric was measured according to NWSP-110.4.R0 (20).

The absorption capacity (in g/g) with water of the nonwoven fabric was measured according to NWSP 010.1.R0 (20) and EN 1644-1:1997, with the exception that the samples are not conditioned for 24 hours prior to testing and the test is not carried out in a room with standard humidity.

The bending length (in mm) in both machine direction (MD) and cross direction (CD) and for both sides of the nonwoven fabric was measured according to SFS-EN ISO 9073-7:1998 and NWSP 090.5.R0 (20), with the exception that the samples were not conditioned prior to testing.

The Atlas pilling (in %) of the nonwoven fabric was measured according to the standard SFS 3378:2002.

The static and dynamic friction factor for dry and wet nonwoven fabric was measured according to ISO 8295:1995, except that the sample size was 120 mm×70 mm. The dry samples were conditioned as indicated in the standard, the wet samples as mentioned above (in a plastic bag for 16 hours, i.e. overnight).

Figure 2A:
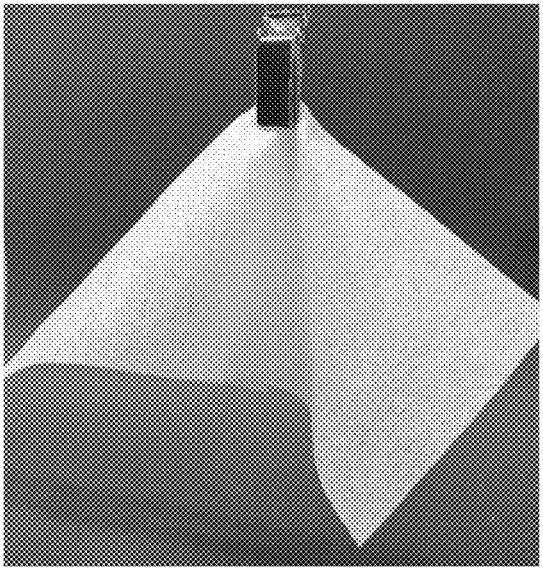
FIGS. 2A and 2B illustrate the test set up for the softness value test.
Figure 2B:
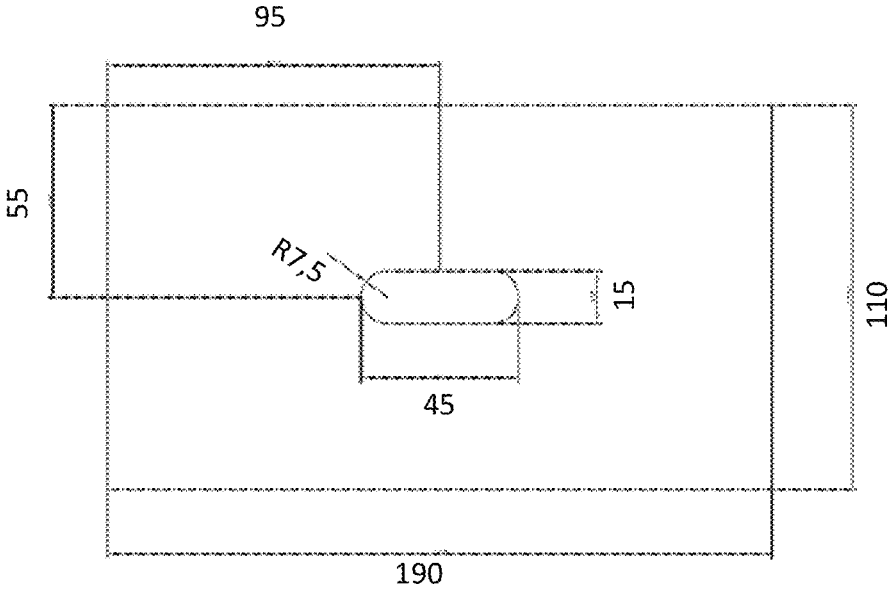

The softness value in N/10 cm for dry and wet nonwoven fabric was measured using a sample of 160×180 mm (160 mm in MD, 180 mm in CD) attached at its central point to a mounting clip, which mounting clip is attached to a machine used for measuring friction factors according to ISO 8295:1995, which samples are thereafter drawn using a speed of 1000 mm/minute and force as in ISO 8295:1995, through an opening in a test plate, which opening has a stadium shape with a size of 45×15 mm with ends having a radius of 7.5. FIG. 2A illustrate the attachment of the mounting clip and the mounting clip, and FIG. 2B shows the test plate and the dimensions of the opening.

Tables 3 and 4 give the results for a number of tests for all the examples and comparative example 1. It can be observed that the concerning the thickness wet, lyocell absorbs more water than hemp. When the content of hemp is increased, water increasingly remains in between the fibres. Both thus absorb water, but the ability is higher for lyocell. This is not only a positive property, for example in the case of wet wipes. Indeed, during storage the upper wipes can become dry while the lower wipes are too wet. A good dry bulk/wet bulk balance is thus needed, in addition to suitable absorption capacity. Hemp fibres are coarser than lyocell fibres when dry, but become softer when wetted.

While all the examples give products that are suitable, the results also show that for example for the combination of hemp and lyocell, using 50 wt-% of each gives a product in which certain properties are better than if either hemp or lyocell is present in an amount of 75 wt-% of the total weight, the rest being the other fibres. Tensile strength for example should be at a sufficient level in order to be able to properly convert the material into wipes. Squareness, i.e. MD/CD tensile strength needs to be sufficient, again for wipes, as such material is easier to convert and easier to remove from a package. A small elongation in the cross direction is also preferred, so that the wipe does not stretch when removed from the package.

Hemp fibres are thicker than lyocell fibres, and hence have a higher bending length than lyocell. Again, an ideal value is between those of hemp alone and lyocell alone, as a lower bending length makes it easier to fold the wipes into the package, while a higher bending length means that the material is easier to use for wiping, as it does not so easily form a ball.

TABLE 3

| | Ex. 1 | Ex. 2 | Ex. 3 | Comp. ex 1 |
|---|---|---|---|---|
| Basis weight (g/m$^2$) | 48.0 | 45.2 | 50.5 | 46.0 |
| Thickness dry (mm) | 0.45 | 0.47 | 0.45 | 0.40 |
| Thickness wet (mm) | 0.47 | 0.46 | 0.50 | 0.49 |
| Dry bulk (m$^3$/g) | 9.59 | 10.40 | 8.91 | 8.70 |

TABLE 3-continued

| | Ex. 1 | Ex. 2 | Ex. 3 | Comp. ex 1 |
|---|---|---|---|---|
| Wet bulk (m$^3$/g) | 10.02 | 10.18 | 9.90 | 10.65 |
| Tensile strength MD, dry (N/5 cm) | 62.5 | 41.0 | 98.7 | 132.3 |
| Tensile strength CD, dry (N/5 cm) | 23.8 | 13.5 | 36.1 | 39.1 |
| Elongation MD, dry (max, %) | 10.9 | 6.9 | 15.0 | 13.6 |
| Elongation CD, dry (max, %) | 54.6 | 58.5 | 64.9 | 60.8 |
| Tensile strength MD, wet (N/5 cm) | 52.6 | 30.73 | 79.27 | 101.07 |
| Tensile strength CD, wet (N/5 cm) | 21.7 | 12.70 | 32.20 | 34.95 |
| Elongation MD, wet (max, %) | 20.6 | 18.3 | 20.9 | 20.9 |
| Elongation CD, wet (max, %) | 64.12 | 68.75 | 65.39 | 70.03 |
| Abs. capacity (g/g) with water | 7.4 | 7.2 | 8.0 | 8.6 |
| Bending length (mm) | | | | |
| MD side 1 | 108 | 118 | 86 | 69 |
| MD side 2 | 104 | 109 | 80 | 65 |
| CD side 1 | 49 | 50 | 36 | 29 |
| CD side 2 | 46 | 49 | 34 | 26 |

TABLE 4

| | Ex. 4 | Ex. 5 | Ex. 6 |
|---|---|---|---|
| Basis weight (g/m$^2$) | 49.8 | 41.4 | 48.6 |
| Thickness dry (mm) | 0.43 | 0.39 | 0.41 |
| Thickness wet (mm) | 0.45 | 0.41 | 0.46 |
| Dry bulk (m$^3$/g) | 8.63 | 9.42 | 8.4 |
| Wet bulk (m$^3$/g) | 9.04 | 9.90 | 9.5 |
| Tensile strength MD, dry (N/5 cm) | 53.8 | 45.8 | 66.3 |
| Tensile strength CD, dry (N/5 cm) | 18.7 | 16.3 | 27.9 |
| Elongation MD, dry (max, %) | 11.2 | 8.9 | 13.9 |
| Elongation CD, dry (max, %) | 56.8 | 64.1 | 66.5 |
| Tensile strength MD, wet (N/5 cm) | 30.37 | 36.94 | 55.4 |
| Tensile strength CD, wet (N/5 cm) | 12.72 | 14.56 | 24.4 |
| Elongation MD, wet (max, %) | 22.8 | 18.1 | 24.7 |
| Elongation CD, wet (max, %) | 67.99 | 73.34 | 67.0 |
| Abs. capacity (g/g) with water | 7.5 | 7.9 | 8.3 |
| Bending length (mm) | | | |
| MD side 1 | 107 | 103 | 112 |
| MD side 2 | 102 | 102 | 94 |
| CD side 1 | 46 | 37 | 45 |
| CD side 2 | 44 | 35 | 42 |

TABLE 5

| | Ex. 1 | Ex. 2 | Ex. 3 | Comp. ex. 1 |
|---|---|---|---|---|
| Friction factor (dry) | | | | |
| Static | 0.3599 | 0.3616 | 0.3314 | 0.3275 |
| Dynamic | 0.3079 | 0.2956 | 0.2951 | 0.2911 |
| Friction factor (wet) | | | | |
| Static | 0.4971 | 0.5743 | 0.4641 | 0.4196 |
| Dynamic | 0.5110 | 0.5769 | 0.4802 | 0.4229 |
| Atlas pilling | | | | |
| 1. Weight change % | 5.9 | 2.4 | 5.1 | |
| 2. Weight change % | 12.4 | 7.6 | 10.0 | |
| 3. Weight change % | 17.5 | 11.0 | 15.5 | |

TABLE 6

| | Ex. 5 | Ex. 6 | Comp. ex. 2 |
|---|---|---|---|
| Friction factor (dry) | | | |
| Static | 0.4146 | 0.411 | 0.4318 |
| Dynamic | 0.3899 | 0.430 | 0.4259 |

TABLE 6-continued

| | Ex. 5 | Ex. 6 | Comp. ex. 2 |
|---|---|---|---|
| Friction factor (wet) | | | |
| Static | 0.5191 | | 0.5778 |
| Dynamic | 0.5420 | | 0.6378 |
| Atlas pilling | | | |
| 1. Weight change % | 4.3 | 3.0 | 2.9 |
| 2. Weight change % | 11.4 | 6.5 | 4.3 |
| 3. Weight change % | 17.8 | 8.3 | 4.6 |

As can be seen from Tables 5 and 6, the nonwoven fabric comprising 50 wt-% of hemp fibres and 50 wt-% of lyocell fibres has a wet dynamic friction factor that is 15% lower than for the viscose nonwoven fabric. The higher Atlas pilling (which is an indication of durability of the material) of the materials according to the present invention compared to the material made of 100% viscose (Comparative example 2) is an indication of the better dispersibility of the nonwoven fabric. Indeed, when the fabric already partially breaks during the use (i.e. wiping), it will also biodegrade faster. The pilling is however not critical in the sense that the material is typically of single use, and hence pilling has no significant influence on the end use of the product.

TABLE 7

| | Ex. 1 | Ex. 2 | Ex. 3 | Comp. ex. 1 |
|---|---|---|---|---|
| Dry softness | 2.34 | 1.67 | 1.59 | 1.00 |
| Wet softness | 0.60 | 0.36 | 0.80 | 0.50 |

TABLE 8

| | Ex. 5 | Comp. ex. 2 | Comp. ex. 3 |
|---|---|---|---|
| Dry softness | 0.99 | 0.47 | 0.59 |
| Wet softness | 0.63 | 0.42 | 0.46 |

As can be seen from Tables 7 and 8, the nonwoven fabric comprising 50 wt-% of hemp fibres and 50 wt-% of lyocell fibres has a dry softness that is over 100% higher than for the viscose nonwoven fabric (Comparative example 2), while the wet softness is only 50% higher. It is to be noted that for wet and dry softness, a lower value means softer product.

DETAILED DESCRIPTION OF THE DRAWINGS

FIG. 1 illustrates a production line according to one embodiment. The line comprises two cards 1 at the beginning. The feeding of the fibres is not illustrated in this Figure. After cards, the line comprises three hydroentangling units 2, followed by dewatering unit 3. Drying of the nonwoven fabric is carried out in the dryer 4, whereafter the nonwoven fabric is wound on a roll (not illustrated).

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention.

The verbs "to comprise" and "to include" are used in this document as open limitations that neither exclude nor require the existence of also un-recited features. The features recited in depending claims are mutually freely combinable unless otherwise explicitly stated. Furthermore, it is to be understood that the use of "a" or "an", i.e. a singular form, throughout this document does not exclude a plurality.

The invention claimed is:

1. A method for producing a nonwoven fabric, the method comprising the steps of:

providing fibres comprising 10-100 wt-% of bast fibres, the bast fibres having at least one angle of at least 20°, wherein the angle is an angle measured within a single fiber, and the bast fibres having an average fibre length of 10-60 mm, carding the fibres and forming a web of fibres on a wire support, hydroentangling the formed web by using at least a first and a second hydroentangling unit, wherein a cumulative hydroentanglement energy in the first hydroentangling unit is lower than a cumulative hydroentanglement energy in the second hydroentangling unit, and wherein the cumulative hydroentanglement energy in the first hydroentangling unit is 20-40% of the total hydroentanglement energy used to form the nonwoven, dewatering the hydroentangled web, and drying the dewatered web at a temperature of 105-125° C.

2. The method according to claim 1, wherein the fibres used is a mixture of fibres comprising 10-90 wt-% of bast fibres and 10-90 wt-% of man-made fibres.

3. The method according to claim 1, wherein the bast fibres are selected from a group consisting of hemp fibres, nettle fibres, flax fibres, jute fibres, ramie fibres, kenaf fibres, and mixtures thereof.

4. The method according to claim 3, wherein the bast fibres are hemp fibres.

5. The method according to claim 2, wherein the man-made fibres are fibres based on cellulose.

6. The method according to claim 5, wherein the fibres based on cellulose are lyocell fibres, paper yarn, viscose fibres, alkali cellulose fibres, cellulose carbamate fibres, cellulose acetate fibres, paper pulp, microfibrillar cellulose, nanofibrillar cellulose, microcrystalline cellulose, regenerated cellulose fibres, rayon fibres, cuprammonium rayon fibres, or mixtures thereof.

7. The method according to claim 2, wherein the mixture of fibres comprises 40-60 wt-% of bast fibres and 40-60 wt-% of man-made fibres.

8. The method according to claim 2, wherein the mixture of fibres comprises 40-60 wt-% of hemp fibres and 40-60 wt-% of lyocell fibres.

9. The method according to claim 2, wherein the mixture of fibres comprises 20-40 wt-% of bast fibres and 60-80 wt-% of man-made fibres.

10. The method according to claim 1, further comprising using a third hydroentanglement unit, wherein the cumulative hydroentanglement energy in the third hydroentangling unit is higher than the cumulative hydroentanglement energy in the first hydroentangling unit and lower than the cumulative hydroentanglement energy in the second hydroentangling unit.

11. The method according to claim 1, further comprising pre-wetting the fibres after carding and before hydroentangling.

12. The method according to claim 1, wherein the bast fibres are crimped prior to the providing step.

13. The method according to claim 12, wherein the bast fibres are pre-treated with a coating prior to crimping.

14. The method according to claim 1, wherein the fibers are calendared after the drying step.

15. The method according to claim 1, wherein the first hydroentanglement unit is disposed on a first side of the web of fibers and the second hydroentanglement unit is disposed on a second side of the web of fibres.

16. The method according to claim 1, wherein the first hydroentangling unit hydroentangles the web of fibers against a first drum and the second hydroentangling unit hydroentangles the web of fibers against a second drum.

17. A method for producing a nonwoven fabric, the method comprising the steps of:

providing fibres comprising 10-100 wt-% of bast fibres, the bast fibres defining only one angle per fiber of at least 20°, wherein the angle is an angle measured within a single fiber, and the bast fibres of the nonwoven fabric having an average fibre length of 20-60 mm, carding the fibres and forming a web of fibres on a wire support, hydroentangling the formed web by using at least a first and a second hydroentangling unit, wherein a hydroentanglement energy in the first hydroentangling unit is lower than the hydroentanglement energy in the second hydroentangling unit, dewatering the hydroentangled web, and drying the dewatered web.

* * * * *